US011787652B2

(12) United States Patent
Masuda

(10) Patent No.: US 11,787,652 B2
(45) Date of Patent: Oct. 17, 2023

(54) MEDIUM TRANSPORTING DEVICE, IMAGE READING APPARATUS, AND TRANSPORTING CONTROL METHOD

(71) Applicant: SEIKO EPSON CORPORATION, Tokyo (JP)

(72) Inventor: Hidetoshi Masuda, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 175 days.

(21) Appl. No.: 17/297,597

(22) PCT Filed: Sep. 9, 2019

(86) PCT No.: PCT/JP2019/035391

§ 371 (c)(1),
(2) Date: May 27, 2021

(87) PCT Pub. No.: WO2020/110412

PCT Pub. Date: Jun. 4, 2020

(65) Prior Publication Data

US 2022/0030129 A1 Jan. 27, 2022

(30) Foreign Application Priority Data

Nov. 30, 2018 (JP) ..... 2018-224995

(51) Int. Cl.
*B65H 7/14* (2006.01)
*B65H 7/08* (2006.01)
(Continued)

(52) U.S. Cl.
CPC ..... *B65H 7/14* (2013.01); *B65H 3/063* (2013.01); *B65H 7/08* (2013.01); *B65H 7/10* (2013.01);
(Continued)

(58) Field of Classification Search
CPC ..... B65H 3/063; B65H 3/0661; B65H 7/06; B65H 7/08; B65H 7/10; B65H 7/14;
(Continued)

(56) References Cited

U.S. PATENT DOCUMENTS 8,630,024 B2 * 1/2014 Shiraishi ..... B65H 7/14 271/145
2006/0159471 A1 7/2006 Yasukawa et al.
(Continued)

FOREIGN PATENT DOCUMENTS

JP 2003-205654 A 7/2003
JP 2006-193286 A 7/2006
(Continued)

OTHER PUBLICATIONS

International Search Report of PCT/JP2019/035391 dated Nov. 19, 2019.

*Primary Examiner* — Prasad V Gokhale
(74) *Attorney, Agent, or Firm* — WORKMAN NYDEGGER

(57) ABSTRACT

The medium transporting device is arranged so as to face the feeder for feeding the medium in the transporting direction and the surface of the medium transported in the transporting direction, and detects the motion of the medium in the two-dimensional coordinate system including the first axis and the second axis. The two-dimensional sensor is provided in a state in which the first axis and the second axis are inclined with respect to the transporting direction.

8 Claims, 13 Drawing Sheets

(51) Int. Cl.
*B65H 7/10* (2006.01)
*B65H 3/06* (2006.01)
*B65H 7/18* (2006.01)

(52) U.S. Cl.
CPC ..... *B65H 7/18* (2013.01); *B65H 2513/10* (2013.01); *B65H 2513/40* (2013.01)

(58) Field of Classification Search
CPC ..... B65H 7/18; B65H 2301/4232; B65H 2301/42328; B65H 2511/214; B65H 2511/216; B65H 2511/23; B65H 2513/10; B65H 2513/40
See application file for complete search history.

(56) References Cited

U.S. PATENT DOCUMENTS

| | | | | |
|---|---|---|---|---|
| 2007/0237558 | A1* | 10/2007 | Nakanishi ..... | H04N 1/00005<br>399/394 |
| 2010/0098471 | A1* | 4/2010 | Satoh ..... | G03G 15/6567<br>399/361 |
| 2018/0220022 | A1* | 8/2018 | Yoshi ..... | H04N 1/00755 |

FOREIGN PATENT DOCUMENTS

| | | | |
|---|---|---|---|
| JP | 2007-276982 | A | 10/2007 |
| JP | 2010-116214 | A | 5/2010 |
| JP | 2018-135208 | A | 8/2018 |
| JP | 2019-029794 | A | 2/2019 |

* cited by examiner

MEDIUM TRANSPORTING DEVICE, IMAGE READING APPARATUS, AND TRANSPORTING CONTROL METHOD

TECHNICAL FIELD

The present invention relates to a medium transporting device that transports a medium and an image reading apparatus including the medium transporting device. The present invention also relates to a transporting control method in a medium transporting device.

BACKGROUND ART

In the related art, a method of detecting skew of a medium and performing predetermined control is adopted in an image reading apparatus or a recording apparatus. For example, PTL 1 discloses an ink jet printer configured to detect skew of a paper using a motion sensor, change a reciprocating range of the carriage according to the amount of skew, and not discharge ink to a place other than the paper.

CITATION LIST

Patent Literature

PTL 1: Japanese Unexamined Patent Application Publication No. 2003-205654

SUMMARY OF INVENTION

Technical Problem

The motion sensor has a two-dimensional semiconductor image sensor in which pixels are arranged vertically and horizontally and composed of 20×20 pixels, for example. The two-dimensional semiconductor image sensor receives reflected light from a paper and an image is acquired. Thereafter, the motion sensor analyzes the acquired image, calculates the transported amount of paper transported in the transporting direction (hereinafter it is referred to as the "amount of vertical movement") and the transported amount of paper moved in a direction orthogonal to the transporting direction (hereinafter it is referred to as the "amount of horizontal movement") and outputs the detection value.

When the motion sensor is manufactured in-house, the specification of the output value (detection value) can be set as desired but when a distribution product is used or the like the specification of the output value cannot be changed. Further, depending on the motion sensor, when image analysis fails and the movement direction and the amount of movement of the detection target cannot be acquired, it is common that instead of outputting an error, zero value is output for the amount of vertical movement and the amount of horizontal movement.

In this case, a control section of the image reading apparatus or the recording apparatus cannot discriminate, for example, whether the output value of the motion sensor is zero due to the occurrence of a jam, or whether the output value is zero due to the failure in the image analysis. Therefore, even though the paper is normally transported, there is a possibility that it may be erroneously determined as a transport abnormality according to the output value of the motion sensor.

Solution to Problem

To solve the above problems, a medium transporting device of the present invention includes a feeder that feeds a medium in a transporting direction and a two-dimensional sensor that is disposed to face a surface of the medium transported in the transporting direction and detects a motion of a medium in a coordinate system including a first axis and a second axis, in which the two-dimensional sensor is provided in a state in which the first axis and the second axis form inclination angles with respect to the transporting direction.

DESCRIPTION OF EMBODIMENTS

Figure 1:
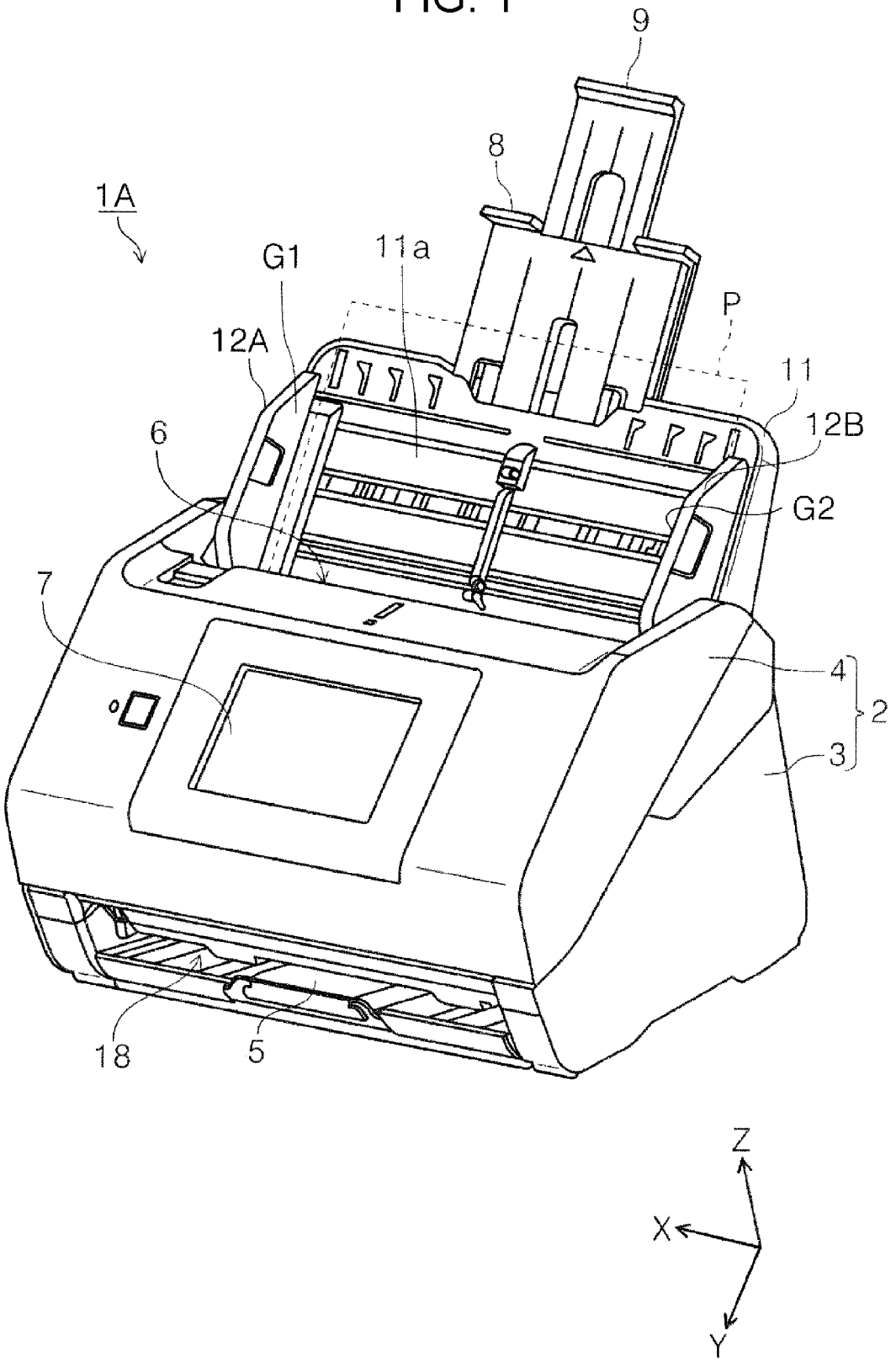
FIG. 1 is an external appearance perspective view of a scanner.

The present invention will be schematically described below.

A medium transporting device according to a first aspect includes a feeder that feeds a medium in a transporting direction and a two-dimensional sensor that is disposed to face a surface of the medium transported in the transporting direction and detects a motion of the medium in a two-dimensional coordinate system including a first axis and a second axis, in which the two-dimensional sensor is provided in a state in which the first axis and the second axis are inclined with respect to the transporting direction.

According to the present aspect, the medium transporting device includes the two-dimensional sensor that is disposed to face a surface of the medium transported in the transporting direction and detects a motion of the medium in the coordinate system including the first axis and the second axis, in which since the two-dimensional sensor is provided in a state in which the first axis and the second axis are inclined with respect to the transporting direction, for detection values of the two-dimensional sensor, neither a detection value in the first axis direction nor a detection value in the second axis direction becomes zero during normal transport of a medium.

Therefore, discrimination between a transport abnormality of a medium and failure in image analysis by the two-dimensional sensor can be possible, and thereby it is possible to avoid the problem of stopping the transport of a medium by determining that it is a transport abnormality even though no transport abnormality of a medium has occurred.

In a second aspect according to the first aspect, inclination angles of the first axis and the second axis with respect to the transporting direction are 40° to 50°.

According to the present aspect, since the inclination angles of the first axis and the second axis with respect to the transporting direction are 40° to 50°, the difference between the detection value in the first axis direction and the detection value in the second axis direction becomes smaller in a state where a medium is properly transported in the transporting direction without skewing, thereby it becomes easy to distinguish between normal transportation and abnormal transportation.

Further, when the two-dimensional sensor is mounted, by visually mounting the sensor at a target of 45°, a mounting angle can be set in a range of 40° to 50° in most cases, and the mounting work becomes easy.

In a third aspect according to the first or second aspect, a controller that receives a detection value in the first axis direction and a detection value in the second axis direction from the two-dimensional sensor stops the feeder when a difference between a movement speed in the first axis direction and a movement speed in the second axis direction detected by the two-dimensional sensor exceeds a threshold value during an operation of the feeder.

The transport abnormality of a medium quickly appears in the difference between the movement speed in the first axis direction and the movement speed in the second axis direction. According to the present aspect, since the controller determines whether or not to stop the transport of a medium based on the difference between the movement speed in the first axis direction and the movement speed in the second axis direction detected by the two-dimensional sensor during the operation of the feeder, the transport abnormality of a medium can be detected quickly, and as a result, damage to the medium can be minimized.

In a fourth aspect according to the third aspect, the threshold value is a constant value that does not depend on deviation of the inclination angles of the first axis and the second axis with respect to the transporting direction from a target value.

According to the present aspect, it is not necessary to check the deviation of the detection value due to the deviation of the inclination angle from the target value for each individual device, and the cost of the device can be reduced.

In a fifth aspect according to the third aspect, the threshold value is a value set according to deviation of the inclination angles of the first axis and the second axis with respect to the transporting direction from a target value.

According to the present aspect, the threshold value is a value set according to the deviation of the inclination angles of the first axis and the second axis with respect to the transporting direction from the target value, so that the threshold value becomes a value optimized for each individual device, and the transport abnormality can be determined more appropriately.

In a sixth aspect according to the first or second aspect, a controller that receives a detection value in the first axis direction and a detection value in the second axis direction from the two-dimensional sensor stops the feeder when a relationship between an amount of movement in the first axis direction and an amount of movement in the second axis direction detected by the two-dimensional sensor satisfies a predetermined condition during an operation of the feeder.

In a seventh aspect according to the third or sixth aspect, the controller suspends abnormality processing when both the detection value in the first axis direction and the detection value in the second axis direction are below a predetermined level during the operation of the feeder.

When both the detection value in the first axis direction and the detection value in the second axis direction are below the predetermined level during the operation of the feeder, there is a possibility that the two-dimensional sensor cannot properly detect a detection target. According to the present aspect, since the controller suspends the abnormality processing when both the detection value in the first axis direction and the detection value in the second axis direction are below the predetermined level during the operation of the feeder, it is possible to avoid the problem of stopping the transport of a medium by determining that it is a transport abnormality even though no transport abnormality of a medium has occurred.

An image reading apparatus according to an eighth aspect includes a reader that reads a medium and the medium transporting device according to any one of the first to seventh aspects, which transports a medium toward the reader.

According to the present aspect, in the image reading apparatus, any one of the effects of the first to seventh aspects described above may be obtained.

In a transporting control method in a medium transporting device according to a ninth aspect, the medium transporting device includes a feeder that feeds a medium in a transporting direction, and a two-dimensional sensor that is disposed to face a surface of the medium transported in the transporting direction and detects a motion of the medium in a two-dimensional coordinate system including a first axis and a second axis, and the transporting control method includes receiving a detection value in the first axis direction and a detection value in the second axis direction during an operation of the feeder from the two-dimensional sensor that is provided in a state in which the first axis and the second axis form inclination angles with respect to the transporting direction and stopping the feeder when a difference between a movement speed in the first axis direction and a movement speed in the second axis direction exceeds a threshold value.

According to the present aspect, since the two-dimensional sensor is provided in a state in which the first axis and the second axis are inclined with respect to the transporting direction, for detection values of the two-dimensional sensor, neither a detection value in the first axis direction nor a detection value in the second axis direction becomes zero during normal transport of a medium. Therefore, discrimination between a transport abnormality of a medium and failure in image analysis by the two-dimensional sensor can be possible, and thereby it is possible to avoid the problem of stopping the transport of a medium by determining that it is a transport abnormality even though no transport abnormality of a medium has occurred.

In a transporting control method in a medium transporting device according to a tenth aspect, the medium transporting device includes a feeder that feeds a medium in a transporting direction, and a two-dimensional sensor that is disposed to face a surface of the medium transported in the transporting direction and detects a motion of the medium in a two-dimensional coordinate system including a first axis and a second axis, and the transporting control method includes receiving a detection value in the first axis direction and a detection value in the second axis direction during an operation of the feeder from the two-dimensional sensor that is provided in a state in which the first axis and the second axis form inclination angles with respect to the transporting direction and stopping the feeder when a relationship between an amount of movement of the medium in the first axis direction and an amount of movement of the medium in the second axis direction satisfies a predetermined condition.

According to the present aspect, since the two-dimensional sensor is provided in a state in which the first axis and the second axis are inclined with respect to the transporting direction, for detection values of the two-dimensional sensor, neither a detection value in the first axis direction nor a detection value in the second axis direction becomes zero during normal transport of a medium. Therefore, discrimination between a transport abnormality of a medium and failure in image analysis by the two-dimensional sensor can be possible, and thereby it is possible to avoid the problem of stopping the transport of a medium by determining that it is a transport abnormality even though no transport abnormality of a medium has occurred.

In an eleventh aspect according to the ninth or tenth aspect, the method further includes suspending abnormality processing when both the detection value in the first axis direction and the detection value in the second axis direction are below a predetermined level during the operation of the feeder.

When both the detection value in the first axis direction and the detection value in the second axis direction are below the predetermined level during the operation of the feeder, there is a possibility that the two-dimensional sensor cannot properly detect a detection target. According to the present aspect, since the abnormality processing is suspended when both the detection value in the first axis direction and the detection value in the second axis direction are below the predetermined level during the operation of the feeder, it is possible to avoid the problem of stopping the transport of a medium by determining that it is a transport abnormality even though no transport abnormality of a medium has occurred.

Hereinafter, the present invention will be specifically described.

Hereinafter, an embodiment of an image reading apparatus will be described with reference to the drawings. In the present embodiment, as an example of the image reading apparatus, a document scanner (hereinafter simply referred to as a scanner 1A) capable of reading at least one of the front and back surfaces of a document P is taken as an example.

In the X-Y-Z coordinate system shown in each figure, an X direction is an apparatus width direction and a document width direction which is a direction intersecting a document transporting direction. A Y direction is the document transporting direction. A Z direction is a direction intersecting the Y direction, and generally indicates a direction that is orthogonal to a surface of the document P being transported. A +Y direction is a direction from a back surface to a front surface of the apparatus, and a −Y direction is a direction from the front surface to the back surface of the apparatus. When viewed from the front surface of the apparatus, a left direction is a +X direction, and a right direction is a −X direction. A +Z direction is an upper side of the apparatus, and a −Z direction is a lower side of the apparatus. Further, a direction in which the document P is fed (+Y direction) is called "downstream", and an opposite direction (−Y direction) is called "upstream".

FIG. 1 is an external appearance perspective view showing a scanner 1A according to the present invention.

The scanner 1A includes an apparatus main body 2 that includes a reading section 20 (FIG. 2) that reads an image of the document P inside.

The apparatus main body 2 includes a lower unit 3 and an upper unit 4. The upper unit 4 is provided so as to be openable/closable with respect to the lower unit 3 with the downstream in the document transporting direction as a turning fulcrum point. The upper unit 4 is rotated and opened in a front surface direction of the apparatus so that the feeding path of the document P is exposed and jamming processing of the document P can be easily performed.

A document placement section 11 having a placement surface 11*a* on which the document P to be fed is placed is provided in the vicinity of an apparatus's back surface of the apparatus main body 2. The document placement section 11 is provided with respect to the apparatus main body 2 in an attachable/detachable manner.

A pair of edge guides for guiding side edges in the width direction (X direction) intersecting the document transporting direction (Y direction), specifically, a first edge guide 12A and a second edge guide 12B are provided in the document placement section 11. The first edge guide 12A and the second edge guide 12B are provided with guide surfaces G1 and G2 for guiding the side edges of the document P, respectively.

The document placement section 11 includes a first paper support 8 and a second paper support 9. The first paper support 8 and the second paper support 9 can be housed in the document placement section 11 and can be pulled out from the document placement section 11 so that the length of the placement surface 11*a* can be adjusted as shown in FIG. 1.

The apparatus main body 2 includes an operation panel 7 on the front surface of the upper unit 4 device for realizing various reading settings or a reading execution operation, and a user interface (UI) that shows the content of the reading settings or the like. In the present embodiment, the operation panel 7 is a so-called touch panel that can perform both display and input and serves as both an operation section for performing various operations and a display section for displaying various information.

A feeding port 6 connected to the inside of the apparatus main body 2 is provided on the upper part of the upper unit 4, and the document P placed on the document placement section 11 is fed toward the reading section 20 from the feeding port 6 provided inside the apparatus main body 2.

A paper discharging tray 5 for receiving the document P to be discharged is provided on the front surface side of the lower unit 3 device.

Figure 2:
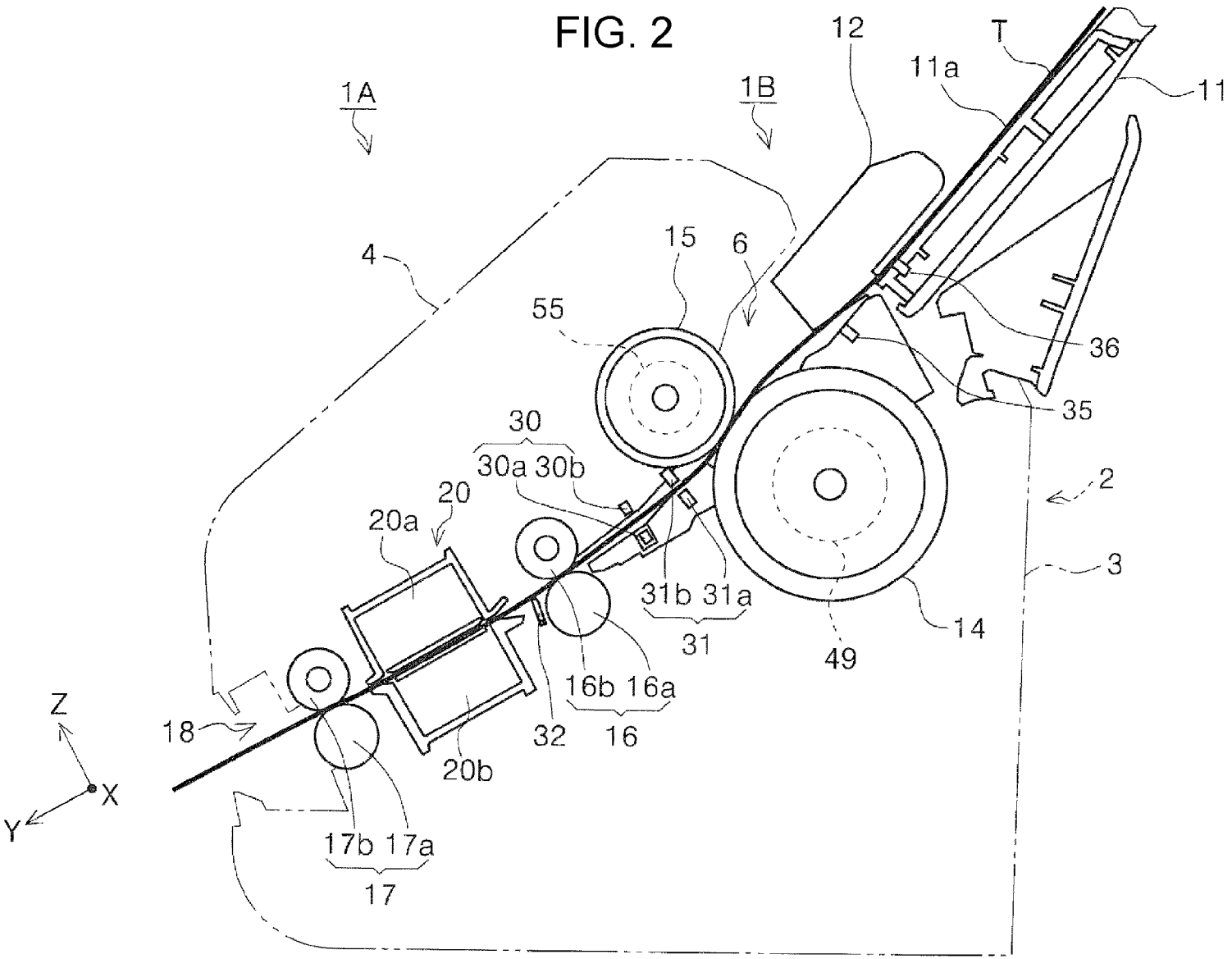
FIG. 2 is a side cross-sectional view showing a document feeding path in the scanner.
Figure 3:
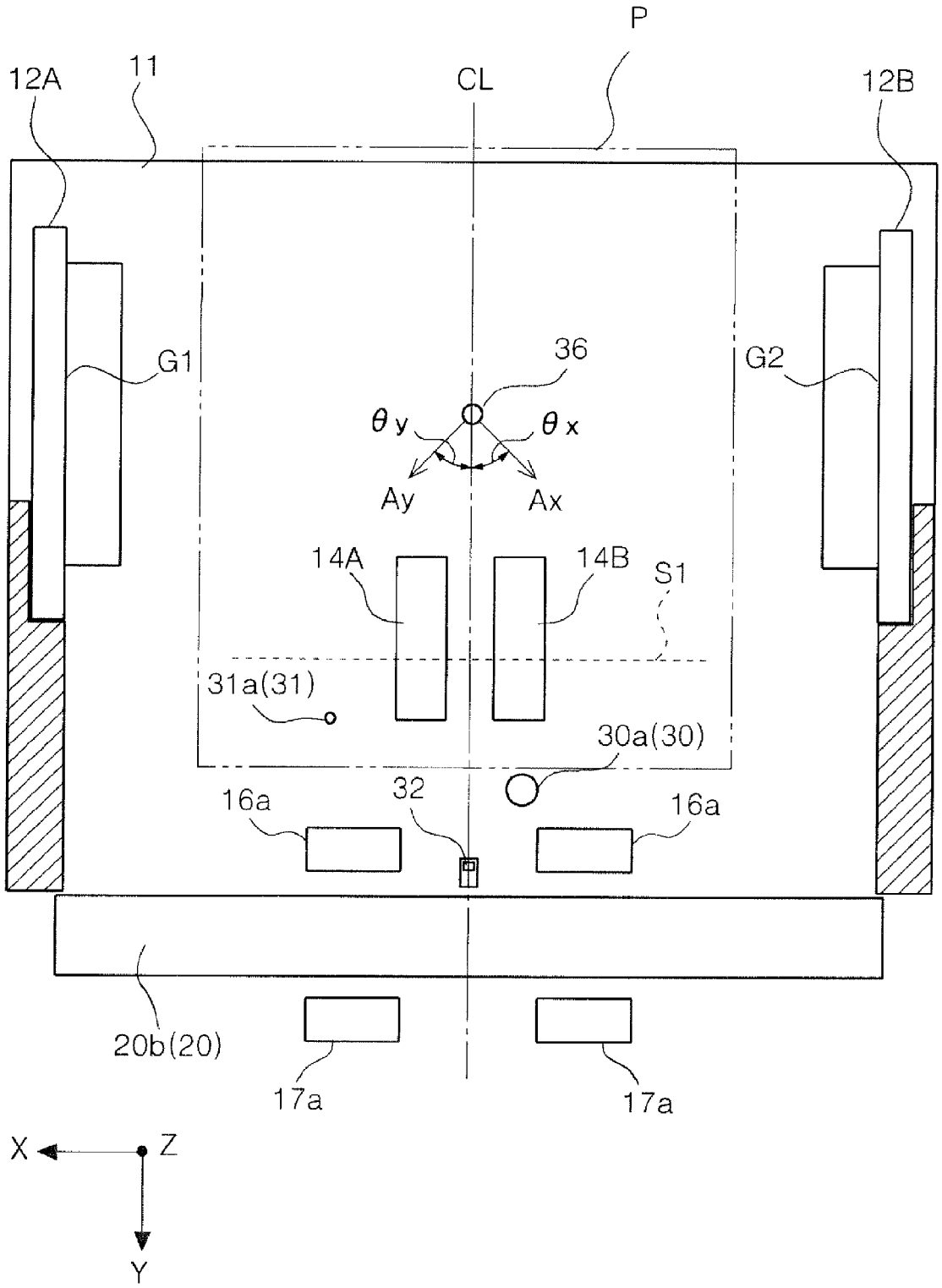
FIG. 3 is a plan view showing a document feeding path in the scanner.

Next, the document feeding path in the scanner 1A will be described mainly with reference to FIGS. 2 and 3. FIG. 2 is a side cross-sectional view showing a document feeding path in the scanner 1A according to the present invention, and FIG. 3 is a plan view thereof.

The scanner 1A includes a medium transporting device 1B (FIG. 2). The medium transporting device 1B can be regarded as a device that omits a function related to document reading from the scanner 1A, specifically, a reading section 20 described later. However, even when the reading section 20 is provided, the scanner 1A itself can be regarded as a medium transporting device if attention is paid to the viewpoint of document transportation.

In FIG. 2, a solid line indicated by a symbol T indicates the document feeding path, in other words, a passing route of the document P. The document feeding path T is a space interposed between the lower unit 3 and the upper unit 4.

The document placement section 11 is provided on the most upstream of the document feeding path T. A feeding roller 14 that feeds the document P placed on the placement surface 11*a* of the document placement section 11 toward the reading section 20, and a separating roller 15 that nips and separates the document P from the feeding roller 14, are provided on the downstream of the document placement section 11. The document placement section 11 is provided with the edge guide 12 as described above.

The feeding roller 14 is in contact with the bottom-most one of the documents P placed on the placement surface 11*a* of the document placement section 11. Accordingly, when a plurality of documents P are set on the document placement section 11 in the scanner 1A, the documents are fed toward the downstream in order from the document P on the placement surface 11*a* side.

In the present embodiment, as shown in FIG. 3, two feeding rollers 14 are arranged so as to be symmetrical with respect to the center position CL in the document width direction. In FIG. 3, the feeding roller 14 on the left side with respect to the center position CL is indicated by reference numeral 14A, and the feeding roller on the right side with respect to the center position CL is indicated by reference numeral 14B. Similarly, two separating rollers 15 are also arranged so as to be symmetric with respect to the center position CL although not shown in FIG. 3.

In FIG. 3, a broken line S1 indicates a leading end position of the document P placed on the document placement section 11 before starting feeding. In the leading end of the document P placed on the document placement section 11, a leading end position is regulated at the position S1 by a regulating member (not shown). The regulating member moves to a retreating position when feeding operation starts.

Figure 4:
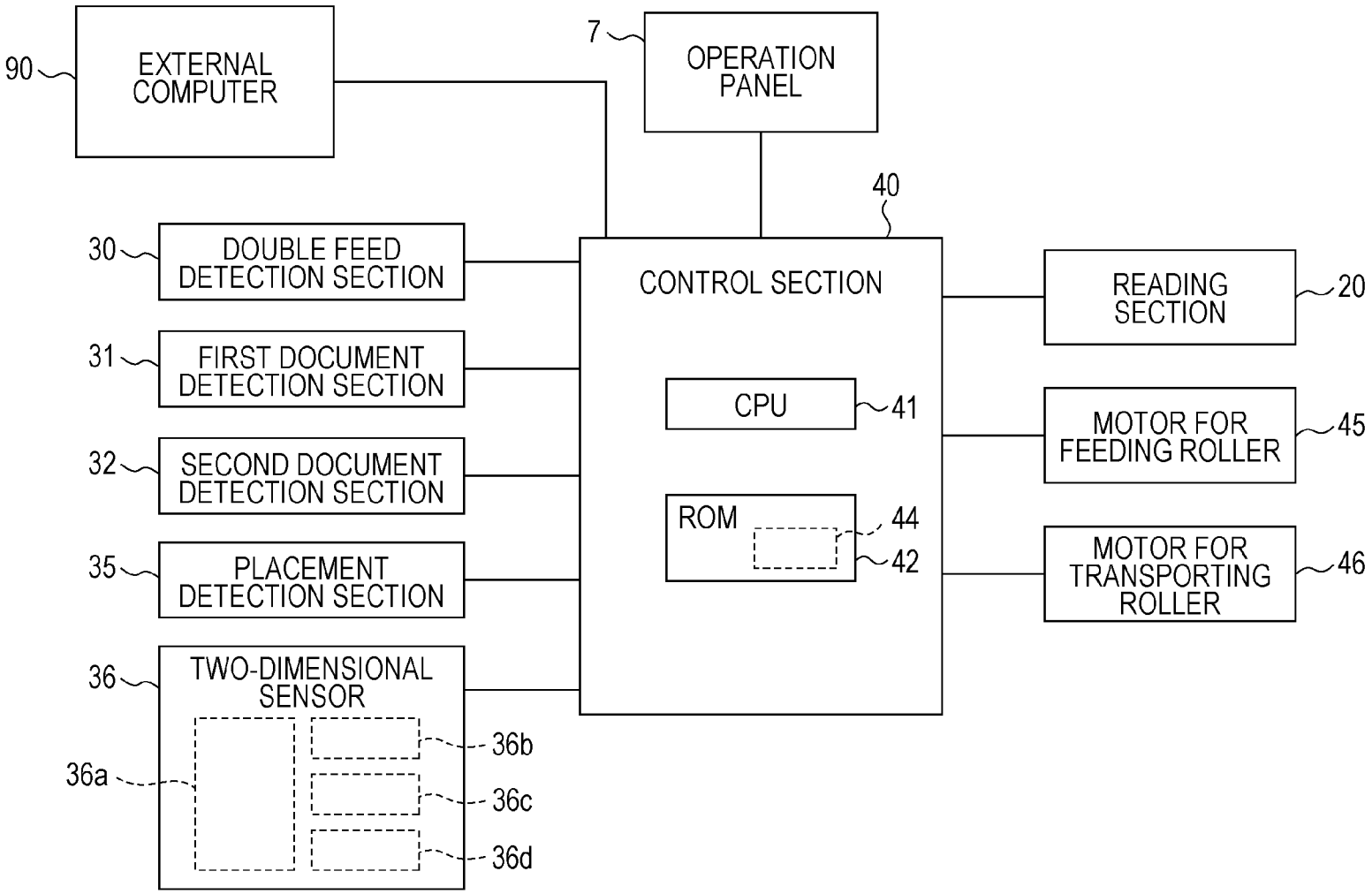
FIG. 4 is a block diagram showing a control system of the scanner.

The feeding roller 14 is rotationally driven by a motor 45 for a feeding roller (FIG. 4). Rotational torque is obtained from the motor 45 for a feeding roller, and the feeding roller 14 rotates counterclockwise in FIG. 2.

Next, rotational torque is transmitted to the separating roller 15 from the motor 46 for a transporting roller (FIG. 4) via a torque limiter (not shown).

When the document P does not intervene between the feeding roller 14 and the separating roller 15, or when only one sheet intervenes, the separating roller 15 is driven to rotate regardless of the rotational torque received from the motor 46 for a transporting roller (clockwise direction in FIG. 2) due to slippage in a torque limiter (not shown).

When a second and subsequent document P enters between the feeding roller 14 and the separating roller 15 in addition to the document P to be fed, slippage occurs between the documents, and the separating roller 15 rotates counterclockwise direction in FIG. 2 by the rotational torque received from the motor 46 for a transporting roller. As a result, double feeding of the document P is prevented.

The pair of transporting rollers 16 as a feeder, the reading section 20 that reads an image, and a pair of discharging rollers 17 are provided on the downstream of the feeding roller 14. The pair of transporting rollers 16 includes a transport driving roller 16*a* that is rotationally driven by the motor 46 for a transporting roller (FIG. 4) as a transporting motor and a transport driven roller 16*b* that is driven to rotate. In the present embodiment, two transport driving rollers 16*a* are arranged so as to be symmetrical with respect to the center position CL as shown in FIG. 3. Although not shown in FIG. 3, the two transport driven rollers 16*b* are also arranged so as to be symmetrical with respect to the center position CL.

The document P nipped by the feeding roller 14 and the separating roller 15 and fed downstream is nipped by the pair of transporting rollers 16 and transported to the reading section 20 located on the downstream of the pair of transporting rollers 16.

The reading section 20 includes an upper reading sensor 20*a* provided on the upper unit 4 side and a lower reading sensor 20*b* provided on the lower unit 3 side.

In the present embodiment, the upper reading sensor 20*a* and the lower reading sensor 20*b* are configured as a contact image sensor module (CISM) as an example.

The reading section 20 reads an image of at least one of the front and back surfaces of the document P. Thereafter, the document P is nipped by the pair of discharging rollers 17 located on the downstream of the reading section 20 and discharged from a discharging port 18 provided on the front surface side of the lower unit 3 device.

The pair of discharging rollers 17 includes a discharge driving roller 17*a* that is rotationally driven by the motor 46 for a transporting roller (FIG. 4), and a discharge driven roller 17*b* that is driven to rotate. As shown in FIG. 3, in the present embodiment, two discharge driving rollers 17*a* are arranged so as to be symmetrical with respect to the center position CL.

Similarly, two discharge driven rollers 17*b* are arranged so as to be symmetrical with respect to the center position CL although not shown in FIG. 3.

Hereinafter, a control system in the scanner 1A will be described with reference to FIG. 4. FIG. 4 is a block diagram showing the control system of the scanner 1A according to the present invention.

In FIG. 4, a control section 40 as a controller performs various controls of the scanner 1A including feeding, transporting, discharging, and reading controls of the document P. Signals from the operation panel 7 are input to the control section 40, and signals for realizing display on the operation panel 7 and particularly a user interface (UI), are transmitted from the control section 40 to the operation panel 7.

The control section 40 controls the motor 45 for a feeding roller and the motor 46 for a transporting roller. As described above, the motor 45 for a feeding roller is a driving source of the feeding roller 14 illustrated in FIG. 2, and the motor 46 for a transporting roller is a driving source of the separating roller 15, the pair of transporting rollers 16, and the pair of discharging rollers 17 illustrated in FIG. 2. The motor 45 for a feeding roller and the motor 46 for a transporting roller are both DC motors in the present embodiment.

Data to be read is input from the reading section 20 to the control section 40, and a signal for controlling the reading section 20 is transmitted from the control section 40 to the reading section 20.

Signals from these detectors of a placement detection section 35, a two-dimensional sensor 36, a double feed detection section 30, a first document detection section 31, a second document detection section 32, which will be described later, are also input to the control section 40.

The control section 40 also receives detection values of an encoder that detects the rotation amount of the feeding motor 45 or encoders that detect the rotation amounts of the transport driving roller 16*a* and the discharge driving roller 17*a*. In this way, the control section 40 can detect the amount of document transported by each roller.

The control section 40 includes a CPU 41 and a flash ROM 42. The CPU 41 performs various arithmetic processing according to a program 44 stored in the flash ROM 42 and controls the entire operations of the scanner 1A. Note that a flash ROM, which is an example of a storage section, is a non-volatile memory that can be read and written, and stores data necessary for abnormality determination described later. Unless otherwise specified in this specification, all data necessary for abnormality determination described later, parameters necessary for control, and the like are stored in the flash ROM 42, and values thereof are updated by the control section 40 as necessary. Various setting information input by a user via the operation panel 7 is also stored in the flash ROM 42.

The program 44 stored in the flash ROM 42 does not necessarily mean a single program. The program 44 may be composed of a plurality of programs, including a program for determining an abnormality in the document feeding path T and a program for changing a threshold value to be described later, a program for controlling the UI displayed on the operation panel 7, and various control programs necessary for transporting and reading the document P.

The scanner 1A is configured to be connectable to an external computer 90, and information from the external computer 90 is input to the control section 40. The external computer 90 includes a display section (not shown). In the display section, a user interface (UI) is realized by a control program stored in a storage unit (not shown) provided in the external computer 90.

Next, each detector provided in the document feeding path T will be described.

First, the document placement section 11 is provided with the two-dimensional sensor 36. The two-dimensional sensor 36 faces the bottom-most one of the documents P placed on the document placement section 11.

The two-dimensional sensor 36 is a sensor that is based on the same or similar principle as the sensor that can detect the movement of the detection target in a two-dimensional (plane) coordinate system used for a computer mouse and includes a controller 36*a*, a light source 36*b*, lens 36*c*, and an image sensor 36*d*.

The light source 36*b* is a light source for irradiating the document P placed on the document placement section 11 via the lens 36*c* with light, and in this embodiment, laser light is used for the light source 36*b*. However, a light source such as a red LED, an infrared LED, a laser, a blue LED can be used for the light source 36*b*, for example.

The lens 36*c* guides and irradiates the document P placed on the document placement section 11 with light emitted from the light source 36*b*.

The image sensor 36*d* is a sensor that receives reflected light from the document P placed on the document placement section 11, and an image sensor such as a CMOS or CCD can be used. The image sensor 36*d* is configured to arrange pixels along a first axis Ax direction and a second axis Ay direction orthogonal thereto.

In the present specification, the "first axis Ax direction" does not mean only one of the +Ax direction and the −Ax direction but includes both. Similarly, the "second axis Ay direction" does not mean only one of the +Ay direction and the −Ay direction but includes both.

The controller 36*a* analyzes the image acquired by the image sensor 36*d* and outputs the movement distance Wx in the first axis Ax direction and the movement distance Wy in the second axis Ay direction of the image as detection values (output values). As an image analysis method for the controller 36*a*, a known method used for a computer mouse can be used.

As will be described in detail later, the control section 40 that acquires detection values in the first axis Ax direction and the second axis Ay direction from the two-dimensional sensor 36 uses the acquired detection values to determine a transporting state of a document P that is the bottom-most one of the documents P placed on the document placement section 11 and is being fed. Note that the two-dimensional sensor 36 according to the present embodiment outputs the movement distances Wx and Wy in the first axis Ax direction and the second axis Ay direction to the control section 40, and the output values are reset to zero by an initialization instruction from the control section 40.

The two-dimensional sensor 36 has been described as an optical type as an example but may be a sensor including mechanical-type, more specifically, a trackball, a rotary encoder that detects the rotation of the trackball in the first axis Ax direction, and a rotary encoder that detects the rotation of the trackball in the second axis Ay direction.

Next, a placement detection section 35 for detecting whether or not the document P exists on the document placement section 11 is provided on the downstream of the two-dimensional sensor 36. The placement detection section 35 is constituted by a light source and a sensor that receives a reflected light component of the light emitted from the light source, and the control section 40 can detect the presence or absence of a document P on the document placement section 11 based on the difference in the reflected light intensity between the case where a document P is present on the document placement section 11 and the case where a document P is not present.

The first document detection section 31 is provided on the downstream of the feeding roller 14. The first document detection section 31 is configured as an optical type sensor as an example and includes a light emitting section 31*a* and a light receiving section 31*b* disposed to face each other with the document feeding path T interposed therebetween as shown in FIG. 2. The light receiving section 31*b* transmits an electrical signal indicating the intensity of the detection light to the control section 40 (FIG. 4). When the document P to be transported blocks the detection light emitted from the light emitting section 31*a*, the electrical signal indicating the intensity of the detection light changes, and the control section 40 can detect the passage of the leading end or the trailing end of the document P.

A double feed detection section 30 that detects the double feeding of the document P is disposed downstream of the first document detection section 31. As shown in FIG. 2, the double feed detection section 30 includes an ultrasonic wave transmitting section 30*a* and an ultrasonic wave receiving section 30*b* for receiving ultrasonic waves that are disposed to face each other with the document feeding path T interposed therebetween. The ultrasonic wave receiving section 30*b* transmits an output value corresponding to the detected ultrasonic wave intensity to the control section 40. When double feeding of the document P occurs, the electrical signal indicating the intensity of the ultrasonic wave changes, and the control section 40 can detect the double feeding of the document P.

The second document detection section 32 is provided on the downstream of the double feed detection section 30. The second document detection section 32 is configured as a contact-type sensor having a lever. When the lever rotates according to the passage of the leading end or the trailing end of the document P, the electrical signal sent from the second document detection section 32 to the control section 40 is changed, whereby the control section 40 can detect the passage of the leading end or the trailing end of the document P.

The control section 40 can grasp a position of the document P in the document feeding path T by the first document detection section 31 and the second document detection section 32 described above.

Next, a mounting state of the two-dimensional sensor 36 and the abnormality determination related to the transportation of a document P using the two-dimensional sensor 36 will be described. The scanner 1A according to the present embodiment performs an abnormality determination related to the transport of the document P based on a detection value of the two-dimensional sensor 36 and stops transporting the document P as an abnormality occurrence when a predetermined condition is satisfied. In the present embodiment, specifically, the motor 45 for a feeding roller and the motor 46 for a transporting roller are stopped.

As described above, the two-dimensional sensor 36 includes the image sensor 36*d* in which pixels are arranged along the first axis Ax direction and the second axis Ay direction orthogonal to the first axis Ax direction, and as shown in FIG. 3, the first axis Ax and the second axis Ay are installed so as to be inclined with respect to the Y direction, which is the document transporting direction.

In FIG. 3, the angle θx is an angle formed by the first axis Ax with respect to the Y direction, and the angle θy is an angle formed by the second axis Ay with respect to the Y direction.

The angles θx and θy are the angles resulting from the mounting of the two-dimensional sensor 36 in a process, and in the present embodiment, each of the angles is set to 45° as a target value.

Although the angles θx and θy are angles formed with respect to the Y direction, the angles θx and θy may be, for example, angles formed with respect to a guide surface G1 of a first edge guide 12A and a guide surface G2 of a second edge guide 12B. Alternatively, the angles θx and θy may be angles with respect to the side wall of the document transport path.

Figure 5:
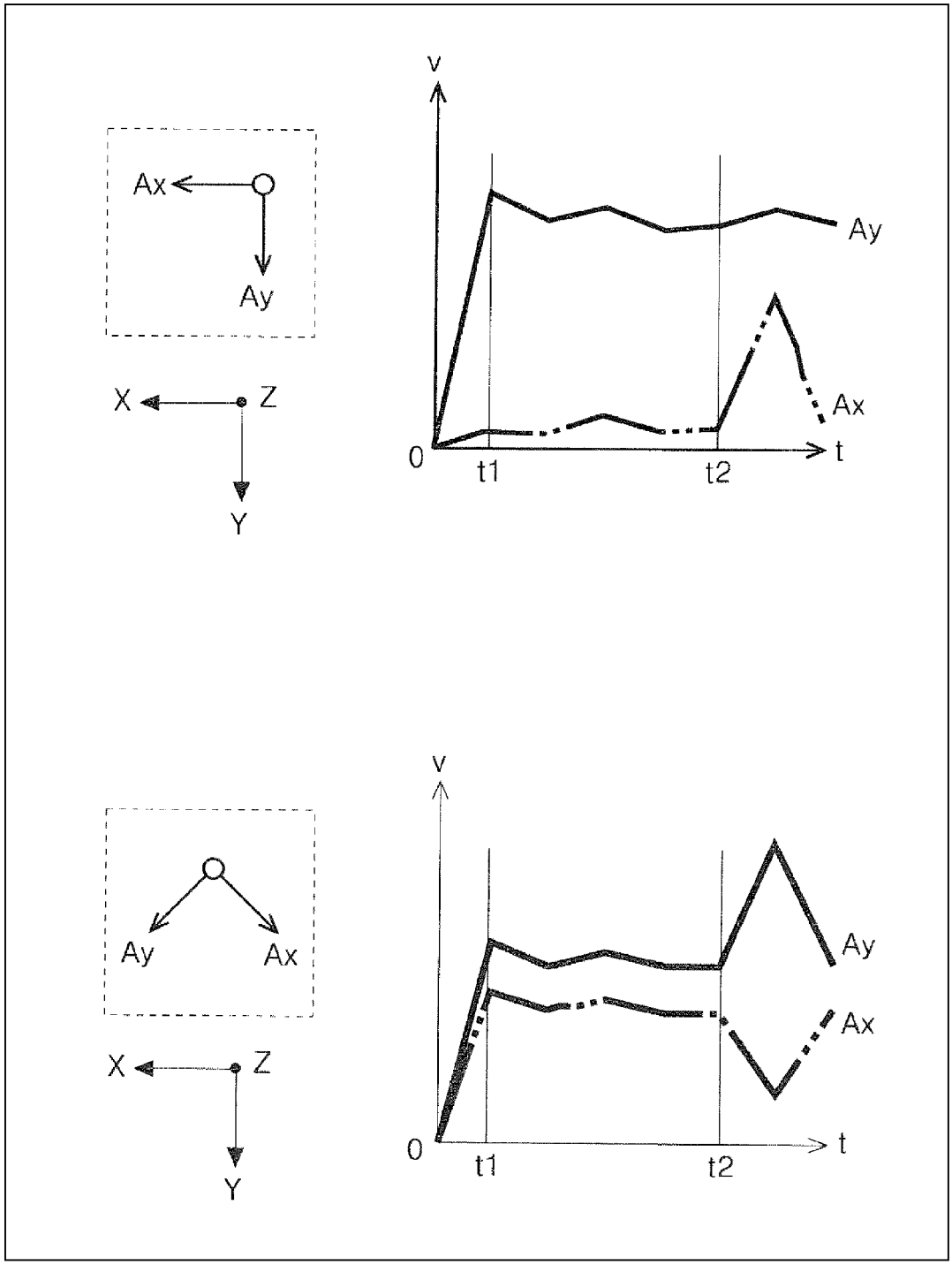
FIG. 5 is a graph showing a relationship between directions of first and second axes of a two-dimensional sensor and detection speeds thereof.

The upper graph in FIG. 5 shows a relationship between a speed and time based on the detection values in the first axis Ax direction and the second axis Ay direction when the two-dimensional sensor 36 is mounted with the angle θy at the target value of 0°, and the lower graph in FIG. 5 shows a relationship between a speed and time based on the detection values in the first axis Ax direction and the second axis Ay direction when the two-dimensional sensor 36 is mounted with the angles θx and θy at the target value of 45°. However, both when the two-dimensional sensor 36 is mounted with the angle θy at the target value of 0° and when the two-dimensional sensor 36 is mounted with the angle θy at the target value of 45°, the actual mounting angle is slightly deviated due to the mounting error, and the graph shown in FIG. 5 assumes the deviation.

Figure 6:
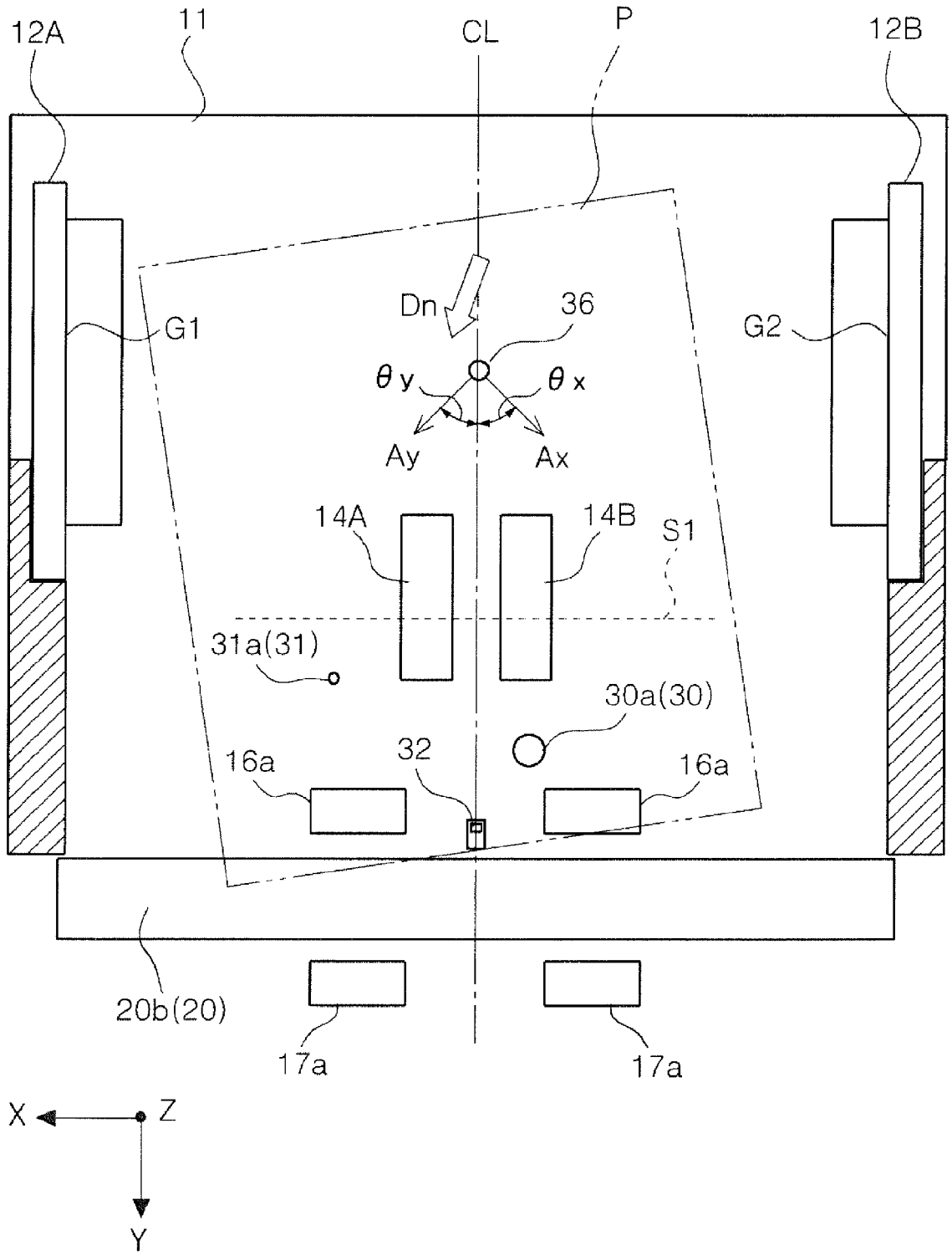
FIG. 6 is a plan view showing a document feeding path in the scanner.

The graph shown in FIG. 5 indicates the speed change in the first axis Ax direction and the second axis Ay direction when skew occurs in the middle after the feeding is started from a state where the document P is stopped, and indicates that the skew started at time t2 in a constant speed zone where an acceleration zone is from time t=0 to t1, and the constant speed zone is after that. The skew of the document P at this time is taken as an example of the skew along the second axis Ay direction as the movement direction of the document P detected by the two-dimensional sensor 36 is indicated by an arrow Dn as shown in FIG. 6.

In the case where the two-dimensional sensor 36 is mounted with the angle θy at the target value of 0° when the document P is transported in the Y direction without skewing, the speed in the first axis Ax direction becomes theoretically zero. Further, when an X direction component is generated in the movement direction of the document P due to the skew of the document P, the change in speed in the first axis Ax direction reflects the generation of the X direction component as it is. In contrast to this, the speed in the second axis Ay direction hardly changes even when the document P is skewed and a movement component in the X direction is generated, or even when the speed in the second axis Ay direction changes, the degree of change is small as compared to the speed change in the first axis Ax direction. The above is represented in the upper graph in FIG. 5.

However, when the two-dimensional sensor 36 fails in image analysis and the detection value becomes zero in both the first axis Ax direction and the second axis Ay direction, since the detection value of the first axis Ax is zero or a value close to zero, it is not possible to evaluate the transport abnormality based on the change of the detection value of the first axis Ax.

Further, since the detection value of the second axis Ay is zero, it can be determined that either the document P has stopped due to an occurrence of a jam or the two-dimensional sensor 36 has failed in image analysis, but it is not possible to specify which of the two.

In contrast to this, in the case where the two-dimensional sensor 36 is mounted with the angles θx and θy at the target value of 45° when the document P is transported in the Y direction without skewing, the speed in the first axis Ax direction and the speed in the second axis Ay direction are theoretically the same. Further, when the X direction component is generated in the movement direction of the document P due to the skew of the document P, both the speed in the first axis Ax direction and the speed in the second axis Ay direction change as shown in the lower graph in FIG. 5, and the speed in the first axis Ax direction decreases and the speed in the second axis Ay direction increases in the example of skew as shown in FIG. 6.

By providing the two-dimensional sensor 36 in this way in a state where the first axis Ax and the second axis Ay are inclined with respect to the Y direction, output values of the two-dimensional sensor 36 do not become zero in either the first axis Ax or the second axis Ay when during normal transport of the document P. Therefore, the discrimination between the transport abnormality of the document P and failure in the image analysis by the two-dimensional sensor 36 can be possible, and thereby it is possible to avoid the problem of stopping the transport of the document P by determining that it is a transport abnormality even though no transport abnormality of the document P has occurred.

Further, when the two-dimensional sensor 36 is mounted with the angle θy at the target value of 0°, it is necessary to perform precise angle adjustment in the manufacturing process of the apparatus but by setting the angle θy to a value other than the target value of 0°, it is not necessary to perform precise angle adjustment in the manufacturing process of the apparatus, and the manufacturing of the apparatus becomes easy.

Further, by providing the two-dimensional sensor 36 in a state where the first axis Ax and the second axis Ay are inclined with respect to the Y direction, the detection speeds in the first axis Ax direction and the second axis Ay direction are slower than the document transporting speed in the Y direction. Therefore, it is not necessary to directly correspond the resolution of the two-dimensional sensor 36 to the document movement speed in the Y direction, that is, a sensor having a low resolution can be used, in other words, even when the document transporting speed in the Y direction is increased, the two-dimensional sensor 36 can follow the speed.

In the present embodiment, by setting the target values of angles θx and θy, that is, the mounting angles to 45° as described above, the detection value in the first axis Ax direction and the detection value in the second axis Ay direction are almost the same in absolute value when the document P is properly transported in the transporting direction without skewing, thereby it becomes easy to distinguish between normal transportation and abnormal transportation. Further, when the two-dimensional sensor 36 is mounted, by visually mounting the sensor at a target of 45°, a mounting angle can be set in a range of 40° to 50° in most cases, and the mounting work becomes easy. When the mounting angle is in the range of 40° to 50°, the difference between the detection value in the first axis Ax direction and the detection value in the second axis Ay direction becomes small, thereby it becomes easy to distinguish between normal transportation and abnormal transportation.

The angle θx (θy) of the two-dimensional sensor 36 in the actual mounting state is preferably in the range of 20° to 70°, and more preferably in the range of 40° to 50°. However, even when the range is outside the above angle range, it suffices when both the detection value in the first axis Ax direction and the detection value in the second axis Ay direction are at an angle that is stable and larger than zero in a state where the document P is transported straight in the transporting direction without skewing.

Figure 7:
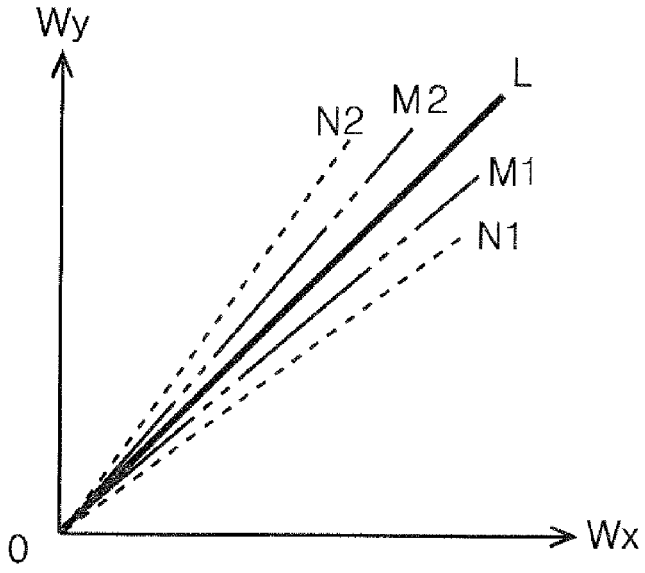
FIG. 7 is a graph showing a relationship between movement distances of the first axis and the second axis detected by the two-dimensional sensor.

Next, the setting of the conditions for determining whether or not it is a transport abnormality will be described. FIG. 7 shows a relationship between the movement distance Wx in the first axis Ax direction and the movement distance Wy in the second axis Ay direction, and the straight line L indicates a relationship between the movement distance Wx in the first axis Ax direction and the movement distance Wy in the second axis Ay direction when the two-dimensional sensor 36 is mounted with the angles θx and θy that do not deviate from the target value of 45° and the document P is transported straight in the Y direction without skewing.

When the document P is skewed and the X direction component is included in the movement direction, since each of the detection values in the first axis Ax direction and the second axis Ay direction changes as described above and moves away from the straight line L, it is determined to be the transport abnormality when the threshold values are set as shown by the broken lines N1 and N2 and the detection values deviate from the threshold values. That is, when the relationship between the movement distance Wx in the first axis Ax direction and the movement distance Wy in the second axis Ay direction satisfies a predetermined condition, it is determined to be the transport abnormality and the document transportation is stopped.

In reality, due to the mounting error of the two-dimensional sensor 36, the relationship between the detection value of the first axis Ax and the detection value of the second axis Ay deviates from the straight line L like the two-dot chain lines M1 and M2 even when the document P is transported straight in the transporting direction without skewing. Therefore, it is preferable to set the broken lines N1 and N2 to a value obtained by adding three times the standard deviation to the average value of the amount of deviation (two-dot chain lines M1 and M2 as examples) from the straight line L between the individual devices, or more preferable to set the broken lines N1 and N2 to further outside than the set value.

In this method, since the threshold value is a constant value that does not depend on the deviation of the mounting angle of the two-dimensional sensor 36 from the target value, the cost of the apparatus can be reduced as compared to the method of checking the deviation of the detection value due to the deviation for each individual device and setting the corresponding threshold value for each individual device.

Further, in a case where the reading resolution during the document scanning changes, the document transporting speed changes, and in a case where the document transporting speed changes, the amount of deviation from the straight line L when a transport abnormality occurs also changes, thereby it is preferable to set the threshold value according to the document transporting speed.

The broken line N1 in FIG. 7 can be represented as Wy=[1+Ca]*Wx (where Ca<0), and the broken line N2 can be represented as Wy=[1+Ca]*Wx (where Ca>0). [1+Ca] corresponds to the slopes of the broken lines N1 and N2 in FIG. 5.

Therefore, when Wy<[1+Ca]*Wx (where Ca<0) or Wy>[1+Ca]*Wx (where Ca>0), it is possible to determine to be a transport abnormality.

The value Ca is stored in the non-volatile memory in advance. The smaller the value Ca, the higher the detection sensitivity of the transport abnormality and the larger the value Ca, the lower the detection sensitivity of the transport abnormality.

Figure 8:
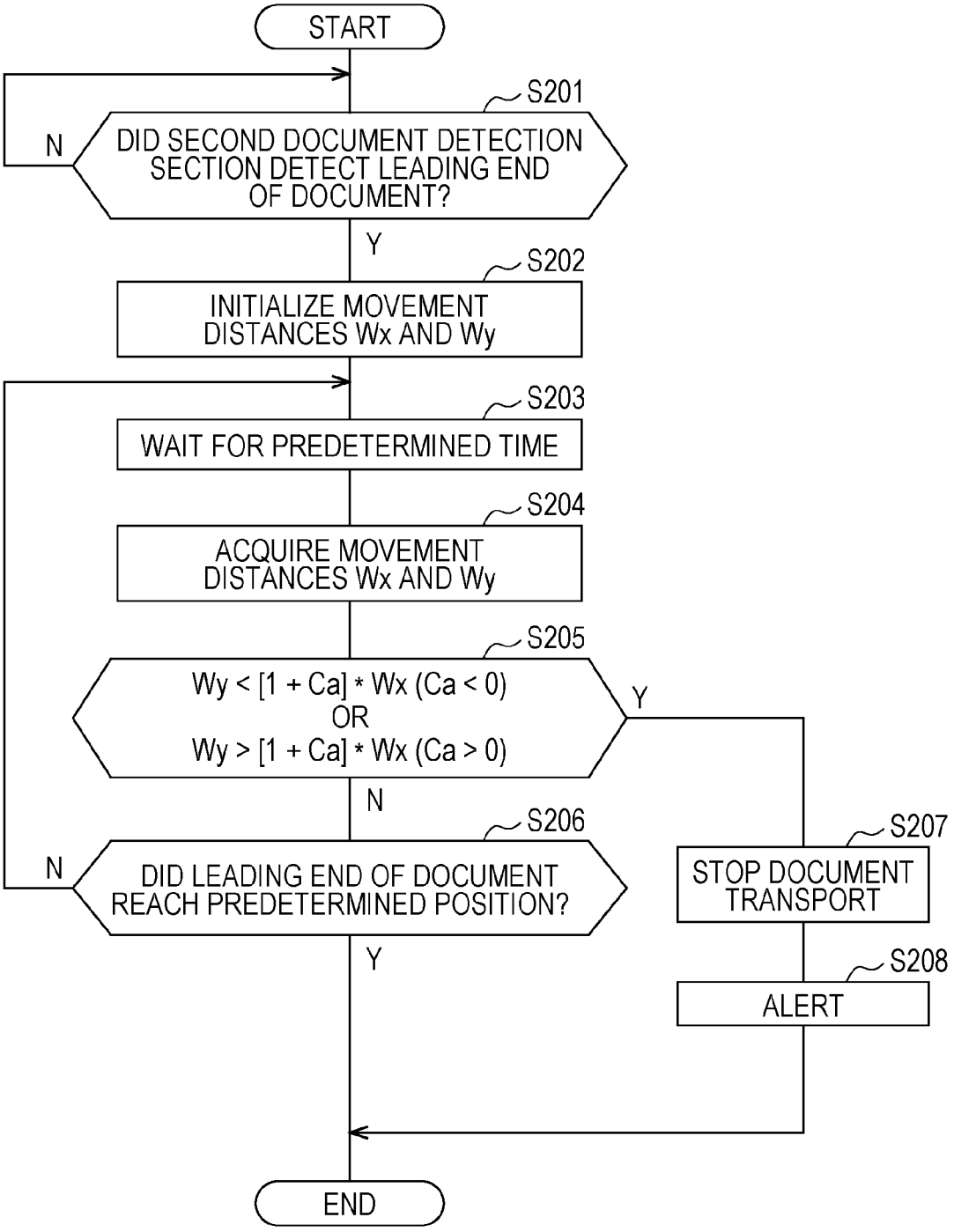
FIG. 8 is a flowchart showing a procedure of abnormality determination processing when scanning is performed.

In a case where a document scanning is performed by a user, when the second document detection section 32 (FIG. 3) detects the leading end of the document (Yes in step S201), the control section 40 initializes the movement distances of the two-dimensional sensor 36 in each of the first axis Ax direction and the second axis Ay direction (step S202) as shown in FIG. 8. Further, waiting (for example, 10 ms) is performed for a predetermined time (step S203), the movement distances Wx and Wy are acquired (step S204), whether it is Wy<[1+Ca]*Wx (where Ca<0) or Wy>[1+Ca]*Wx (where Ca<0) is determined (step S205), and when the condition is satisfied (Yes in step S205), the transport of the document P is stopped (step S207), and an alert is issued indicating that a transport abnormality has occurred (step S208).

When the condition is not satisfied in step S205, the above processing is repeatedly executed until the leading end of the document reaches a predetermined position (for example, downstream of the pair of discharging rollers 17) (step S206).

Figure 9:
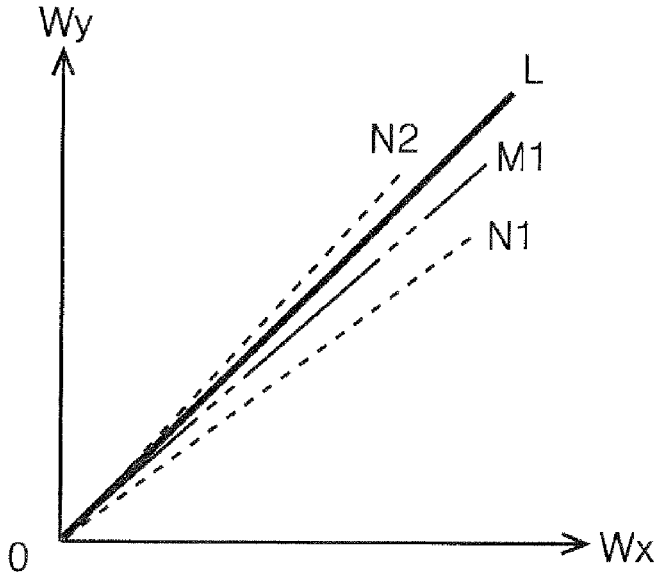
FIG. 9 is a graph showing a relationship between movement distances of the first axis and the second axis detected by the two-dimensional sensor.

In the embodiment described above, the threshold values do not depend on the individual devices and are fixed, but as shown in FIG. 9, the deviation from the target values of the angles θx and θy (two-dot chain line M1 in FIG. 9) is checked for each individual device, and the threshold values (broken lines N1 and N2 in FIG. 9) can be set at equal intervals at the top and bottom according to the deviation. By setting the threshold value in this way, the threshold value becomes a value optimized for each individual device, and the transport abnormality can be determined more appropriately.

Specifically, the threshold value in this case can be set as follows. When the two-dimensional sensor 36 is mounted with the angles θx and θy without deviation from the target value of 45°, the movement distance Wx in the first axis Ax direction and the movement distance Wy in the second axis Ay direction are Wy=Wx, but a mounting error occurs in reality so it satisfies Wy=[1+Da]*Wx. In the example of the two-dot chain line M1 in FIG. 9, it satisfies Da<0.

For this relationship, since the threshold values are set top and bottom, the broken lines N1 and N2 in FIG. 9 can be represented as Wy=[1+Da+Db]*Wx, and in the case of the broken line N1, it satisfies Da<0 and Db<0, and in the case of the broken line N2, it satisfies Da<0 and Db>0.

Therefore, when Wy<[1+Da+Db]*Wx (where Db<0) or Wy>[1−Da+Db]*Wx (where Db>0), it is possible to determine to be a transport abnormality.

The value Db is stored in the non-volatile memory in advance. The smaller the value Db, the higher the detection sensitivity of the transport abnormality and the larger the value Db, the lower the detection sensitivity of the transport abnormality.

Figure 10:
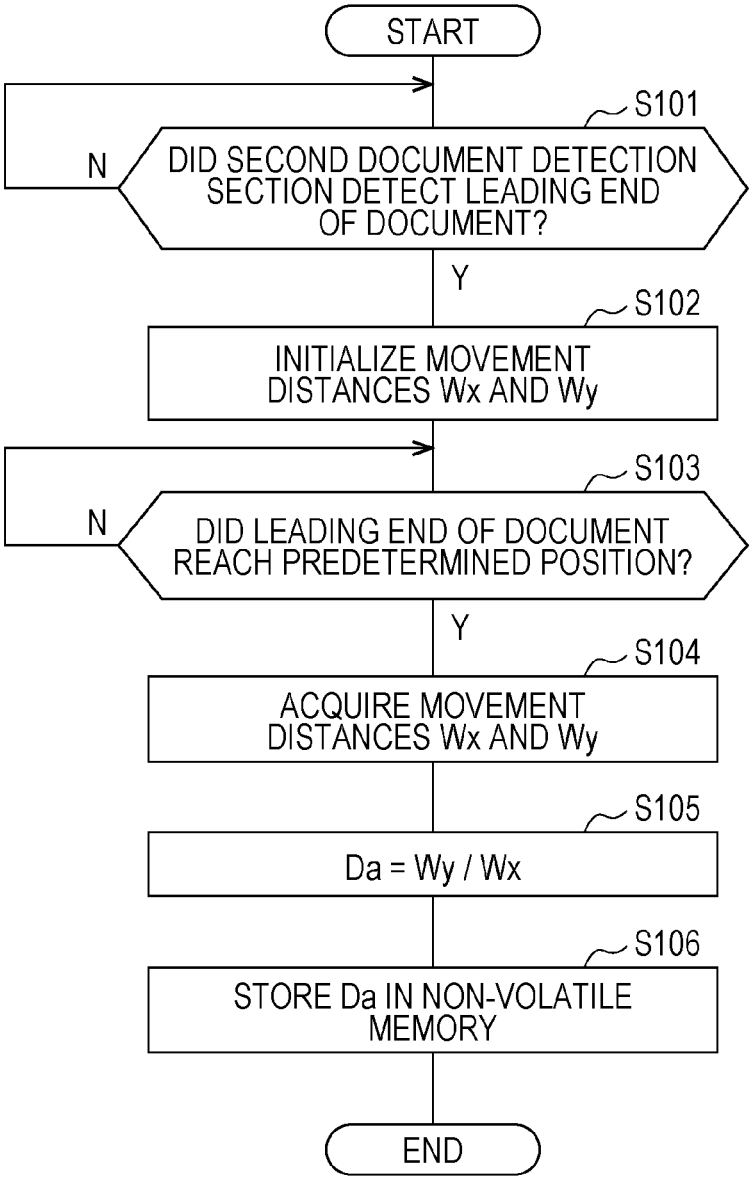
FIG. 10 is a flowchart showing a procedure when an individual dependent value is acquired in a manufacturing process of an apparatus.

FIG. 10 shows the procedure of control executed by the control section 40 in the manufacturing process for obtaining the above value Da, that is, the individual dependent value, and when the second document detection section 32 (FIG. 3) detects the leading end of the document (Yes in step S101), the control section 40 initializes the movement distances of the two-dimensional sensor 36 in each of the first axis Ax direction and the second axis Ay direction (step S102). Next, when the leading end of the document reaches a predetermined position, for example, downstream of the pair of discharging rollers 17 (Yes in step S103), the movement distances Wx and Wy in the first axis Ax direction and the second axis Ay direction are acquired, respectively (step S104), and the value Da is obtained by Wy/Wx (step S105) and stored in the non-volatile memory (step S106).

Further, when acquiring the value Da, it is necessary to perform the acquisition while confirming the state in which the document P is transported straight in the transporting direction without skewing in the transporting direction.

In the embodiment described above, the transport abnormality is determined by using the movement distance Wx in the first axis Ax direction and the movement distance Wy in the second axis Ay direction, but the transport abnormality may be determined by using the movement speed Vx in the first axis Ax direction and the movement speed Vy in the second axis Ay direction.

Figure 11:
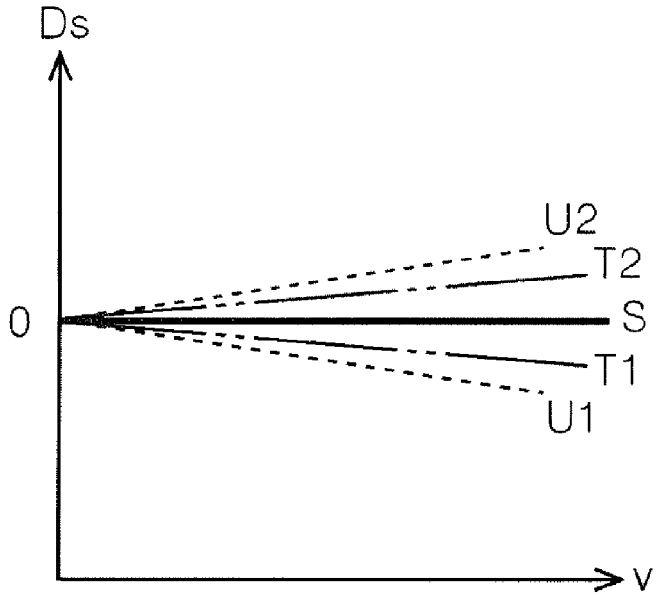
FIG. 11 is a graph showing a relationship between a difference in detection speed between the first and second axes of the two-dimensional sensor and a document feeding speed.

FIG. 11 shows the relationship between the difference Ds between the movement speeds Vx and Vy and the document feeding speed v, and the straight line S shows the difference Ds between the movement speeds Vx and Vy when the two-dimensional sensor 36 is mounted with the angles θx and θy without deviation from the target value of 45° and the document P is transported straight in the Y direction without skewing.

When the document P is skewed and the X direction component is included in the movement direction, since the movement speeds Vx and Vy change and the difference Ds moves away from the straight line S, it is determined to be the transport abnormality when the threshold values are set as shown by the broken lines U1 and U2 and the difference Ds deviates from the threshold values.

In reality, due to the mounting error of the two-dimensional sensor 36, even when the document P is transported straight in the Y direction without skewing, the difference Ds between the movement speeds Vx and Vy deviates from the straight line S like the two-dot chain lines T1 and T2. Therefore, it is preferable to set the broken lines U1 and U2 to a value obtained by adding three times the standard deviation to the average value of the amount of deviation (two-dot chain lines T1 and T2) from the straight line S between the individual devices, and more preferable to set the broken lines U1 and U2 to further outside than the set value.

In this method, since the threshold value is a constant value that does not depend on the deviation of the mounting angle of the two-dimensional sensor 36 from the target value, the cost of the apparatus can be reduced as compared to the method of checking the deviation of the detection value due to the deviation for each individual device and setting the corresponding threshold value for each individual device.

Further, the threshold value needs to be set larger as the document feeding speed v becomes faster but the document feeding speed v is not so high in the scanner 1A according to the present embodiment, and especially after the leading end of the document is nipped into the pair of transporting rollers 16, since the document feeding speed v depends on the rotation speed of the pair of transporting rollers 16 and this rotation speed is set according to the reading resolution, by suspending a threshold value at least for each reading resolution, it is possible to appropriately detect a transport abnormality during document scanning.

Figure 12:
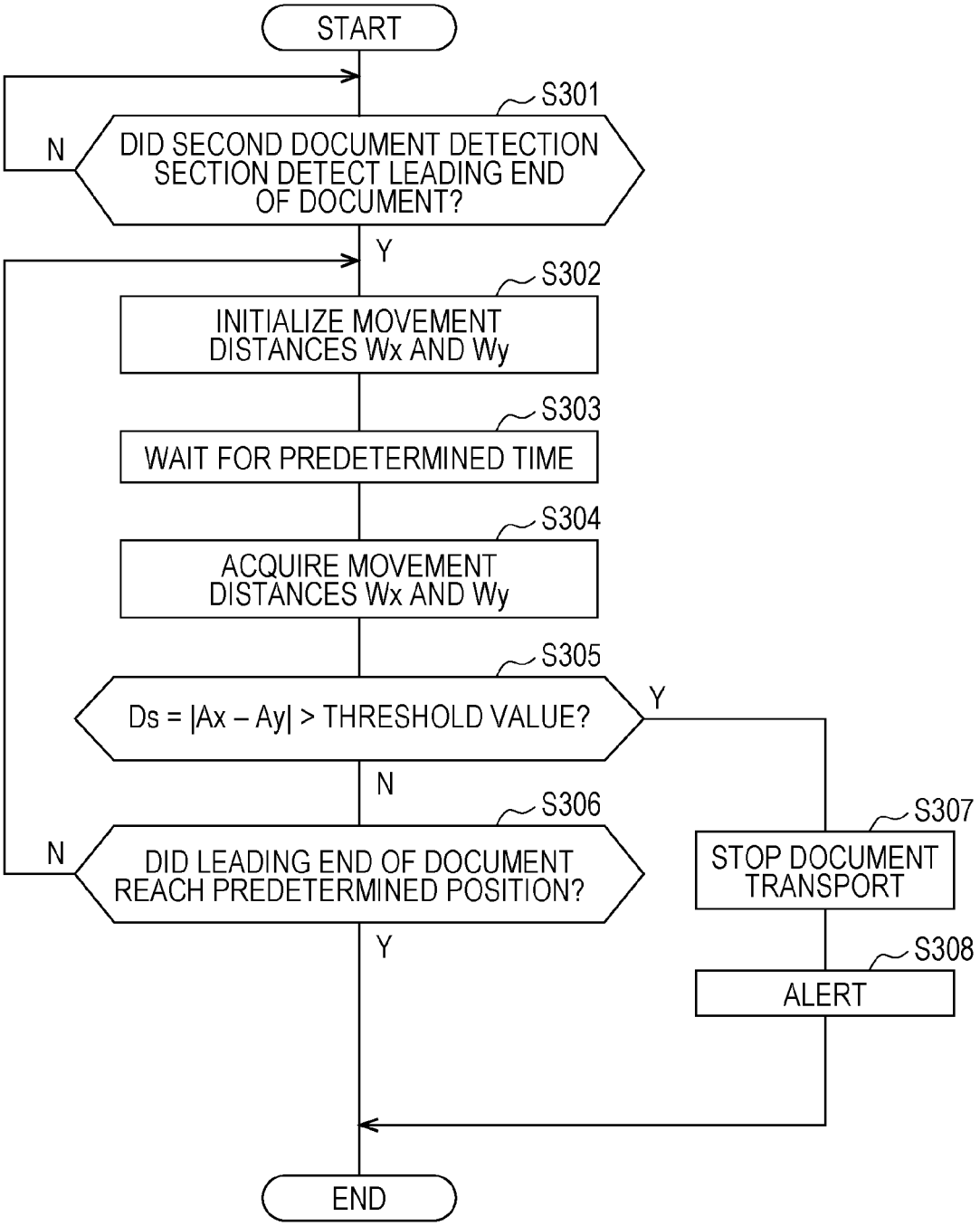
FIG. 12 is a flowchart showing a procedure of abnormality determination processing when scanning is performed.

In a case where a document scanning is performed by a user, when the second document detection section 32 (FIG. 3) detects the leading end of the document (Yes in step S301), the control section 40 initializes the movement distances of the two-dimensional sensor 36 in each of the first axis Ax direction and the second axis Ay direction (step S302) as shown in FIG. 12. Further, waiting (for example, 10 ms) is performed for a predetermined time (step S303), the movement distances Wx and Wy are acquired (step S304), whether the difference Ds, which is the absolute value of the difference, exceeds the threshold value is determined (step S305), and when the condition is satisfied (Yes in step S305), the transport of the document P is stopped (step S307), and an alert is issued indicating that a transport abnormality has occurred (step S308).

When the condition is not satisfied in step S305, the above processing is repeatedly executed until the leading end of the document reaches a predetermined position (for example, downstream of the pair of discharging rollers 17) (step S306).

In the present embodiment, the movement distances Wx and Wy are acquired in the step S304 but it is different from the embodiment described with reference to FIG. 8, and since the movement distances Wx and Wy are initialized each time the waiting (step S303) is performed for a predetermined time, that is, each time the movement distances Wx and Wy are acquired, the movement distances Wx and Wy acquired in the step S304 are the movement speeds per waiting for the predetermined time.

When both the movement distances Wx and Wy acquired in step S304 are below the predetermined level, for example, when it is less than 10% of the value at the time of the previous acquisition, or when it becomes zero, there is a possibility that the image analysis has failed in the two-dimensional sensor 36. Therefore, by suspending, that is, ignoring the abnormality processing, it is possible to avoid the problem of stopping the transport of the document P by determining that it is a transport abnormality even though no transport abnormality of the document P has occurred.

Figure 13:
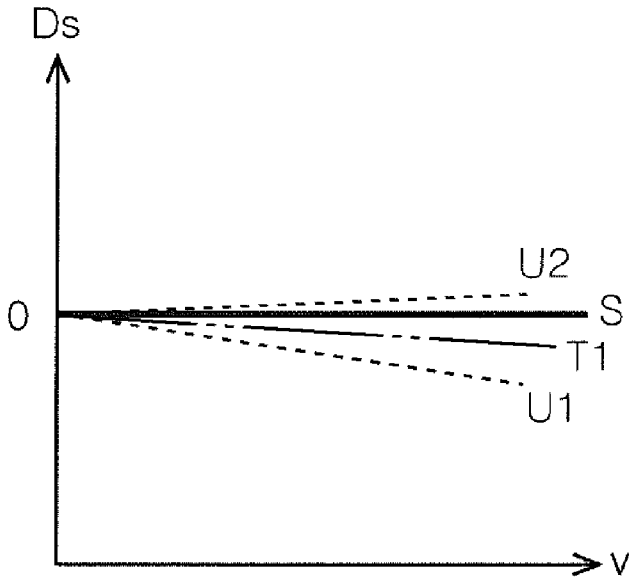
FIG. 13 is a graph showing a relationship between a difference in detection speed between the first and second axes of the two-dimensional sensor and a document feeding speed.

In the embodiment described above, the threshold values do not depend on the individual devices and are fixed, but as shown in FIG. 13, the deviation of the difference Ds between the movement speeds Vx and Vy (two-dot chain line T1 in FIG. 13) is checked for each individual device, and the threshold values (broken lines U1 and U2 in FIG. 13) can be set at equal intervals at the top and bottom according to the deviation. By setting the threshold value in this way, the threshold value becomes a value optimized for each individual device, and the transport abnormality can be determined more appropriately.

The deviation of the difference Ds between the movement speeds Vx and Vy for each apparatus (two-dot chain line T1 in FIG. 13) can be acquired by feeding the document P for each apparatus without actually skewing the document P.

As described above, during the operation of the pair of transporting rollers 16 as the feeder, when the difference Ds between the movement speed Vy in the first axis Ax direction and the movement speed Vy in the second axis Ay direction detected by the two-dimensional sensor 36 exceeds the threshold value, the control section 40 in the present embodiment stops the document transportation as a transport abnormality, so that the transport abnormality of the document P can be quickly detected, and as a result, the damage to the document P can be minimized.

The embodiment described above can be modified as follows.

(1) In the above-described embodiment, a case where the two-dimensional sensor 36 is applied to a scanner which is an example of an image reading apparatus has been described. However, the two-dimensional sensor 36 can also be applied to a recording apparatus, which is represented by a printer, having a recording head for recording on a medium.

(2) In the above-described embodiment, the case where the two-dimensional sensor 36 is disposed in the document placement section 11 has been described, but the present invention is not limited to this, and the two-dimensional sensor 36 may be provided at any position downstream from the feeding roller 14.

(3) In the above-described embodiment, a transport abnormality determination by the two-dimensional sensor 36 may be configured to be switchable between a state where it is executed and a state where it is not executed according to a user setting.

(4) When the resolutions of the two-dimensional sensor 36 in the first axis Ax direction and the second axis Ay direction are not the same but different, it is preferable to set the mounting angle accordingly. For example, for the angles θx and θy in FIG. 3, when the resolution in the first axis Ax direction is lower than the resolution in the second axis Ay direction, it is preferable to mount the two-dimensional sensor 36 so that the angle θx is larger than the angle θy.

(5) In the above-described embodiment, the two-dimensional sensor 36 has the controller 36*a* (FIG. 4), the controller 36*a* analyzes an image acquired by the image sensor 36*d*, and the amount of movement of the image in the first axis Ax direction and the amount of movement in the second axis Ay direction are output to the control section 40 as detection values (output values). However, the control section 40 may be configured to perform the function of the controller 36*a*.

(6) In the above-described embodiment, the feeding roller 14 and the two-dimensional sensor 36 are configured to face the bottom-most document P among the documents P placed on the document placement section 11. However, the feeding roller 14 and the two-dimensional sensor 36 may be configured to face the uppermost document P among the documents P placed on the document placement section 11.

REFERENCE SIGNS LIST

1A . . . scanner (image reading apparatus), 1B . . . document transporting device, 2 . . . apparatus main body, 3 . . . lower unit, 4 . . . upper unit, 5 . . . paper discharging tray, 6 . . . feeding port, 7 . . . operation panel, 8 . . . first paper support, 9 . . . second paper support, 11 . . . document placement section, 12A, 12B . . . edge guide, 14 . . . feeding roller, 15 . . . separating roller, 16 . . . a pair of transporting rollers, 16*a* . . . transport driving roller, 16*b* . . . transport driven roller, 17 . . . a pair of discharging rollers, 17*a* . . . discharge driving roller, 17*b* . . . discharge driven roller, 18 . . . discharging port, 20 . . . reading section, 20*a* . . . upper reading sensor, 20*b* . . . lower reading sensor, 30 . . . double feed detection section, 30*a* . . . ultrasonic wave transmitting section, 30*b* . . . ultrasonic wave receiving section, 31 . . . first document detection section, 31*a* . . . light emitting section, 31*b* . . . light receiving section, 32 . . . second document detection section, 35 . . . placement detection section, 36 . . . two-dimensional sensor, 36*a* . . . controller, 36*b* . . . light source, 36*c* . . . lens, 36*d* . . . image sensor, 40 . . . control section, 41 . . . CPU, 42 . . . flash ROM, 44 . . . program, 45 . . . motor for a feeding roller, 46 . . . motor for a transporting roller, 90 . . . external computer, P . . . document

The invention claimed is:

1. A medium transporting device comprising:

a placement tray on which a medium is placed;

a feeding roller that is in contact with a first surface of the medium, which is a surface facing the placement tray, and feeds the medium;

a separating roller that is in contact with a second surface of the medium, which is a surface opposite to the first surface, and performs separation by nipping a document between the separating roller and the feeding roller;

a feeder that feeds the medium in a transporting direction; and a two-dimensional sensor that is disposed to face a surface of the medium transported in the transporting direction and detects a motion of the medium in a two-dimensional coordinate system including a first axis and a second axis, wherein the two-dimensional sensor is provided on the placement tray positioned upstream of the feeding roller and provided in a state in which the first axis and the second axis are inclined with respect to the transporting direction, wherein a controller that receives a detection value in the first axis direction and a detection value in the second axis direction from the two-dimensional sensor stops the feeder when a difference between a movement speed in the first axis direction and a movement speed in the second axis direction detected by the two-dimensional sensor exceeds a threshold value during an operation of the feeder, and wherein the threshold value is a value set according to deviation of the inclination angles of the first axis and the second axis with respect to the transporting direction from a target value.

2. The medium transporting device according to claim 1, wherein inclination angles of the first axis and the second axis with respect to the transporting direction are 40° to 50°.

3. The medium transporting device according to claim 1, wherein the controller that receives the detection value in the first axis direction and the detection value in the second axis direction from the two-dimensional further sensor stops the feeder when a relationship between an amount of movement in the first axis direction and an amount of movement in the second axis direction detected by the two-dimensional sensor satisfies a predetermined condition during an operation of the feeder.

4. The medium transporting device according to claim 1, wherein the controller suspends abnormality processing when both the detection value in the first axis direction and the detection value in the second axis direction are below a predetermined level during the operation of the feeder.

5. An image reading apparatus comprising:

a reader that reads a medium; and the medium transporting device according to claim 1, which transports the medium toward the reader.

6. A transporting control method in a medium transporting device, in which the medium transporting device includes a placement tray on which a medium is placed, a feeding roller that is in contact with a first surface of the medium, which is a surface facing the placement tray, and feeds the medium, a separating roller that is in contact with a second surface of the medium, which is a surface opposite to the first surface, and performs separation by nipping a document between the separating roller and the feeding roller, a feeder that feeds the medium in a transporting direction, and a two-dimensional sensor that is disposed to face a surface of the medium transported in the transporting direction, provided on the placement tray positioned upstream of the feeding roller, and detects a motion of the medium in a two-dimensional coordinate system including a first axis and a second axis, the transporting control method comprising:

receiving a detection value in the first axis direction and a detection value in the second axis direction during an operation of the feeder from the two-dimensional sensor that is provided in a state in which the first axis and the second axis form inclination angles with respect to the transporting direction; and stopping the feeder when a difference between a movement speed in the first axis direction and a movement speed in the second axis direction exceeds a threshold value, wherein the threshold value is a value set according to deviation of the inclination angles of the first axis and the second axis with respect to the transporting direction from a target value.

7. The transporting control method according to claim 6, further comprising:

suspending abnormality processing when both the detection value in the first axis direction and the detection value in the second axis direction are below a predetermined level during the operation of the feeder.

8. A transporting control method in a medium transporting device, in which the medium transporting device includes a placement tray on which a medium is placed, a feeding roller that is in contact with a first surface of the medium, which is a surface facing the placement tray, and feeds the medium, a separating roller that is in contact with a second surface of the medium, which is a surface opposite to the first surface, and performs separation by nipping a document between the separating roller and the feeding roller, a feeder that feeds the medium in a transporting direction, and a two-dimensional sensor that is disposed to face a surface of the medium transported in the transporting direction, provided on the placement tray positioned upstream of the feeding roller, and detects a motion of the medium in a two-dimensional coordinate system including a first axis and a second axis, the transporting control method comprising:

receiving a detection value in the first axis direction and a detection value in the second axis direction during an operation of the feeder from the two-dimensional sensor that is provided in a state in which the first axis and the second axis form inclination angles with respect to the transporting direction; and stopping the feeder when a relationship between an amount of movement of the medium in the first axis direction and an amount of movement of the medium in the second axis direction satisfies a predetermined condition and when a difference between a movement speed in the first axis direction and a movement speed in the second axis direction exceeds a threshold value, wherein the threshold value is a value set according to deviation of the inclination angles of the first axis and the second axis with respect to the transporting direction from a target value.

* * * * *